United States Patent [19]

Hayase et al.

[11] Patent Number: 4,929,159

[45] Date of Patent: May 29, 1990

[54] VARIABLE-DISPLACEMENT ROTARY COMPRESSOR

[75] Inventors: Isao Hayase, Katsuta; Kenichi Ushiku, Toukai; Kunisuke Tejima, Mito; Seiichi Hayashi, Hitachi; Kazuhiko Satoh, Katsuta, all of Japan

[73] Assignee: Hitachi, Ltd., Tokyo, Japan

[21] Appl. No.: 254,585

[22] Filed: Oct. 7, 1988

[30] Foreign Application Priority Data

Oct. 16, 1987 [JP] Japan ..... 62-260873
Jan. 8, 1988 [JP] Japan ..... 63-1202

[51] Int. Cl.[5] ..... F04C 18/344; F04C 29/08

[52] U.S. Cl. ..... 417/295; 417/310; 418/183; 418/255

[58] Field of Search ..... 417/295, 310, 298; 418/183, 188, 255

[56] References Cited

U.S. PATENT DOCUMENTS 3,191,541 6/1965 Brown ..... 418/188
4,345,886 8/1982 Nakayama et al. ..... 418/183
4,621,986 11/1986 Sudo ..... 417/310

FOREIGN PATENT DOCUMENTS 0048982 3/1987 Japan ..... 417/310
0647843 2/1985 Switzerland ..... 418/183

*Primary Examiner*—Leonard E. Smith
*Assistant Examiner*—D. Scheuermann
*Attorney, Agent, or Firm*—Antonelli, Terry, Stout & Kraus

[57] ABSTRACT

A variable-displacement rotary compressor comprises a rotor with a vane and a side plate disposed to abut a side face of the rotor. The side plate has a suction port formed therein to open to both a working chamber abutment face thereof abutting to the rotor side face and a low pressure chamber, and the rotor has a suction path formed therein to open to the working chamber and to an abutment surface of the rotor. The suction path of the rotor communicates with the suction port of the side plate through rotation of the rotor so that a fluid is sucked from the low pressure chamber into the working chamber under suction stroke through the suction path and the suction port.

16 Claims, 14 Drawing Sheets

VARIABLE-DISPLACEMENT ROTARY COMPRESSOR

BACKGROUND OF THE INVENTION

This invention relates to a variable-displacement rotary compressor and, more particularly, to a variable-displacement compressor suitable for an automobile air conditioner.

A conventional variable-displacement rotary compressor is disclosed in a Japanese Utility Model Laid-Open No. 57-58791, where a rotary compressor comprises a housing having a cylindrical inner surface, a thin cylinder rotatably disposed in the inner suface of the housing, and a rotor hoving movable vanes and rotatably disposed in the cylinder with eccentricity with the cylinder so as to define a working chamber defined by a cylinder inner surface and a rotor outer surface, with the working chamber being divided by the vanes into a plurality of sub-chambers. As the rotor rotates, a fluid is sucked from a suction port into a sub-chamber under suction stroke, compressed and then discharged through a discharge port.

The cylinder has an opening for suction of fluid, which opening is substantially the same area and position as an opening formed in the housing so that the fluid is sucked into the sub-chamber through the overlapped opening. The opening extends in a rotating direction of the rotor from a starting point to a termination point. Capacity control of the rotary compressor is effected by shifting the opening of the cylinder relative to the opening of the housing through rotation of the cylinder and changing the overlapped opening area so as to change an amount of suction fluid.

In this compressor, suction of fluid into the working chamber starts when a forward vane of the sub-chamber under suction stroke has passed at the starting point of the suction opening and completes when a backward vane has passed the terminating point of the suction opening. Expressing the suction opening and a vane pitch rotational angles $\theta p$, $\theta v$ of the rotor, the suction is effected by an rotational angle $\theta p+\theta v$. In the capacity control of this rotary compressor, the suction opening rotational angle $\theta p$ is changed by rotating the cylinder to change the capacity of the compressor. When the capacity is controlled to a minimum capacity, the suction opening rotational angle $\theta p$ can be changed to zero. However, the vane pitch can not be changed and has a certain value, so that the suction is effected by a rotational angle $\theta v$ of the vane pitch $\theta v$. Therefore, in case of capacity control of the conventional variable-displacement rotary compressor, the minimum capacity is limited.

SUMMARY OF THE INVENTION

An object of the present invention is to provide a variable-displacement rotary compressor having a the sufficiently small minimum capacity in its capacity control and a wide capacity control range.

The object of the invention is achieved by providing a variable-displacement rotary compressor comprising comprises a cylinder, a rotor disposed in said cylinder with an outer surface of the rotor in a contact with or in a close relationship to an inner surface of the cylinder at least at one circumferential position thereof and spaced from the inner surface of the cylinder at other circumferential positions to form a working chamber between the outer surface of the rotor and the inner surface of the cylinder, with at least a movable vane being provided in the rotor to divide the working chamber into a plurality of chambers. Side plate cover side faces of the cylinder, with a suction passage comprising a suction port being formed in one of the side plates at an abutment position with the rotor side face where the working chamber increases, as the rotor rotates. A suction path is formed in the rotor for communicating the suction port of the side plate with the increasing working chamber so the fluid is drawn into the working chamber through the suction port of the side plate and the suction path of the rotor.

In this rotary compressor, suction is effected when an opening of the suction path opened to the side face of the rotor is fluidly connected with the suction port of the side plate.

A rotational angle of the opening of the suction path of the rotor can be reduced to a sufficiently small angle, and a rotational angle of the suction port of the side plate also can be reduced to a small angle irrespective of vane pitch, so that the minimum capacity in the capacity control of the rotary compressor can be reduced to a sufficiently small capacity, whereby the capacity control range can be made wide.

DESCRIPTION OF THE INVENTION

Figure 1:
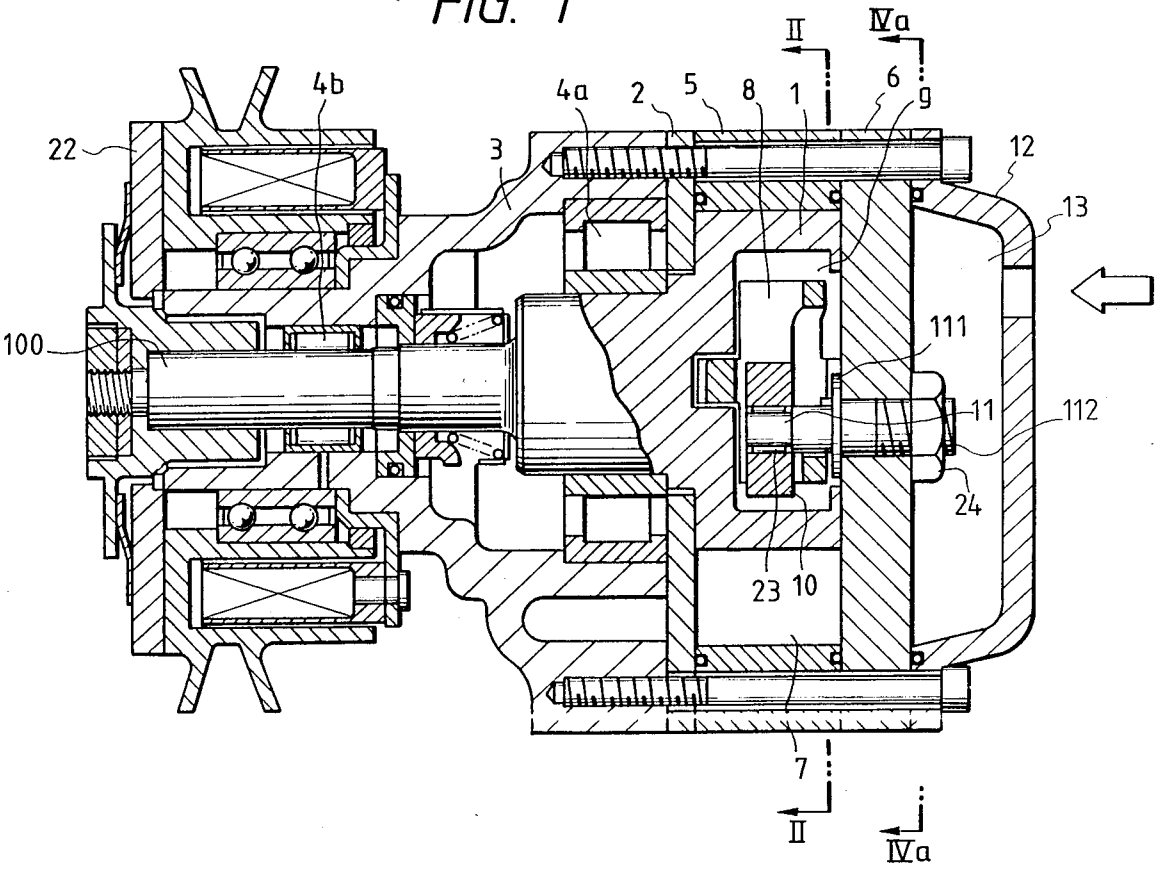
FIG. 1 is a sectional view of a variable-displacement rotary compressor of one embodiment of the present invention.

Referring now to the drawings wherein like reference numerals are used throughout the various views to designate like parts and, more particularly, to FIG. 1, according to this figures, the variable-displacement rotary compressor comprises a cylinder 5 having a cylinder inner surface, with a rotor 1, having a shaft portion 100 being eccentrically disposed in the cylinder 5 so as to contact with the cylindrical inner surface of the cylinder 5 at least at one circumferential position and be spaced therefrom at other circumferential positions whereby a working chamber 7 is formed. A front side plate 2 closes one side of each of the cylinder 5 and the rotor 1, with a front cover 3 being disposed on a side of the front side plate 2 and a rear side plate 6 covering the other sides of the cylinder 5 and the rotor 1. A rear cover 12 is disposed on a side of the rear side plate 6, with a vane 8 being slidably incorporated in the rotor 1. The front cover 3, the front side plate 2, the cylinder 5, the rear side plate 6 and the rear cover 12 are axially stacked and secured by bolts. The rotor 1 is rotatably supported by the front cover 3 through spaced bearings 4*a*, 4*b* with the shaft portion 100 being provided with an electromagnetic clutch 22 whereby an outer rotational force is transmitted to the rotor 1 through the clutch 22 so as to rotate the rotor rotates 1.

Figure 2:
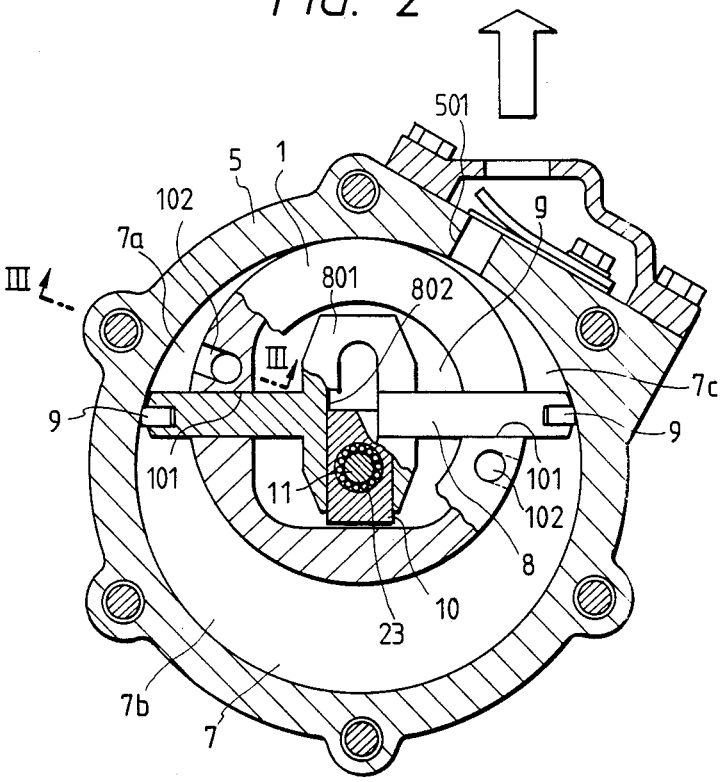
FIG. 2 is a sectional view of the rotary compressor taken along a line II—II of FIG. 1.

As shown most clearly in FIG. 2, the vane 8 is incorporated in the rotor 1 through vane grooves 101 formed in the rotor 1 so as to slide in a longitudinal direction of the vane 8. The vane 8 has a guide portion 801 at a central portion thereof, with the guide portion 801 being disposed in a space g of the rotor 1 and having a cylindrical slide face 802 extending in a perpendicular direction to the longitudinal direction of the vane. In a slider 10, rotatably mounted on a slider pin 11 through a bearing 23 is slidably inserted in the slide face 802. The slider pin 11 is fixed to the rear side plate 6 by a flange portion 111 and a nut 24 threaded on a bolt portion 112 so as to be disposed at a central axis of the cylindrical inner surface of the cylinder 5, and at a position eccentric to the axis of the rotor 1.

The vane 8 has a tip seals 9 incorporated at both ends thereof to provide a seal between the vane tips and the cylindrical inner surface of the cylinder 5, with the tip seal 9 being made, for example, cast iron.

The vane 8 divides the working chamber 7 into three chambers 7*a*, 7*b*, 7*c*, by two projecting vane portions projecting from the outer surface of the rotor 1 and a contacting portion between the cylindrical inner surface of the cylinder 5 and the outer surface of the rotor 1.

Figure 3:
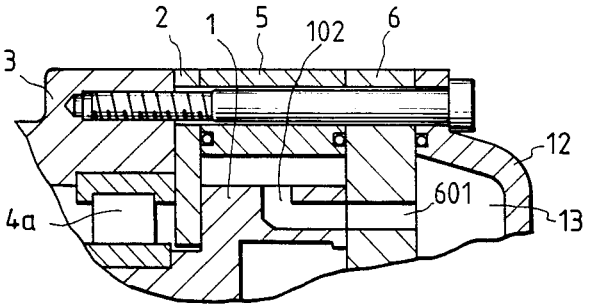
FIG. 3 is an enlarged sectional view of a part of the rotary compressor taken along a line III—III of FIG. 2.

As shown in FIG. 3, the rotor 1 has a suction path 102 formed therein, with one of the suction path 102 being opened to the working chamber 7 and the other end to an abutment between the side face of the rotor 1 and the rear side plate 6. The suction path 102 is positioned at a backside of the vane 8 with respect to the rotational direction of the rotor 1. The rear side plate 6 has a suction port 601 formed therein. An, with an axial end of the suction port 601 being opened to a low pressure chamber 13 formed by the rear side plate 6 and the rear side cover 12 and the other axial end of the suction port 601 opened to the above-mentioned abutment.

The suction port 601 extends in a rotational direction and, when the suction path 102 of the rotor 1 communicates with the suction port 601 of the rear side plate 6 as the rotor 1 rotates, suction of a fluid from the low pressure chamber 13 into the working chamber 7*a* under suction stroke starts and completes when the communication is interrupted.

A starting point or end of the suction port 601 in the rotational direction can be provided at a point at which the suction path entered the working chamber 7*a* a increasing in volume, starts to communicate with the suction port 601 and the terminating point of the suction port 601 can be provided at any desired point, preferably, at a point before the working chamber under suction stroke reaches a maximum capacity. If desired, the terminating point of the suction port 601 can be made close to the starting point, so that the minimum capacity can be reduced according to the desirability.

The variable-displacement rotary compressor is provided with another, second, suction port 602 formed in the rear side plate 6 in order to control the compressor capacity as shown in FIGS. 4*a* to 4*d*. The second suction port 602 communicates the low pressure chamber 13 and the working chamber 7*a* under suction stroke therethrough, that is, the second suction port 602 is formed so as to directly pass through the rear side plate 6 from the lower pressure chamber 13 to the working chamber 7*a* and positioned at a position where the lower pressure chamber 13 communicates with the working chamber 7 until the working chamber reaches to the maximum capacity or volume, that is a state of working chamber 7*b* as shown in FIG. 2. An opening of the second suction port 602 has a diameter smaller than the thickness of the vane 8.

Further, the compressor is provided with a solenoid valve 14 on the second suction port 602 so that the second suction port 602 is opened and closed according to an operation of the solenoid valve 14 thereby providing a fluid connection or disconnection between the working chamber 7 and the low pressure chamber 13.

Figure 4A:
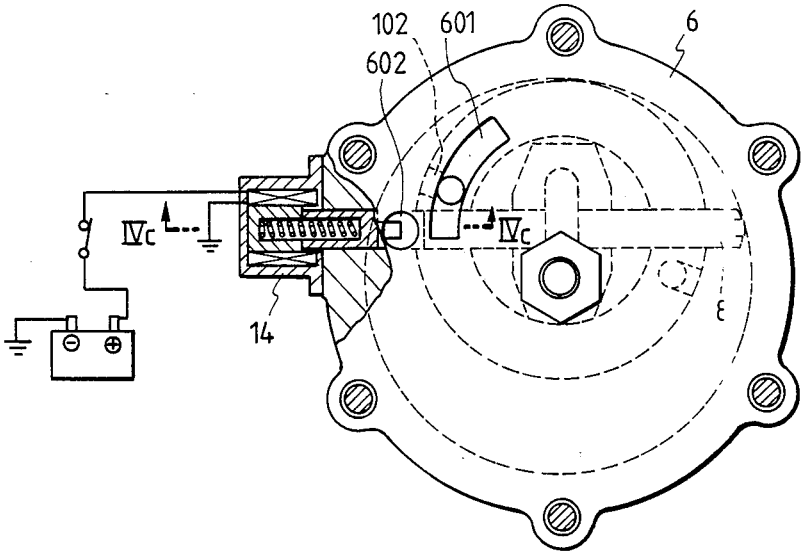
FIG. 4*a* is a sectional view taken along a line IV*a*—IV*a* of FIG. 1.
Figure 4C:
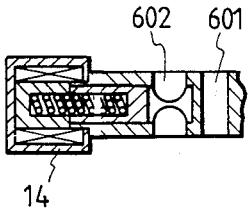
FIG. 4*c* is a sectional view taken along a line IV*c*—IV*c* of FIG. 4*a;*
Figure 5:
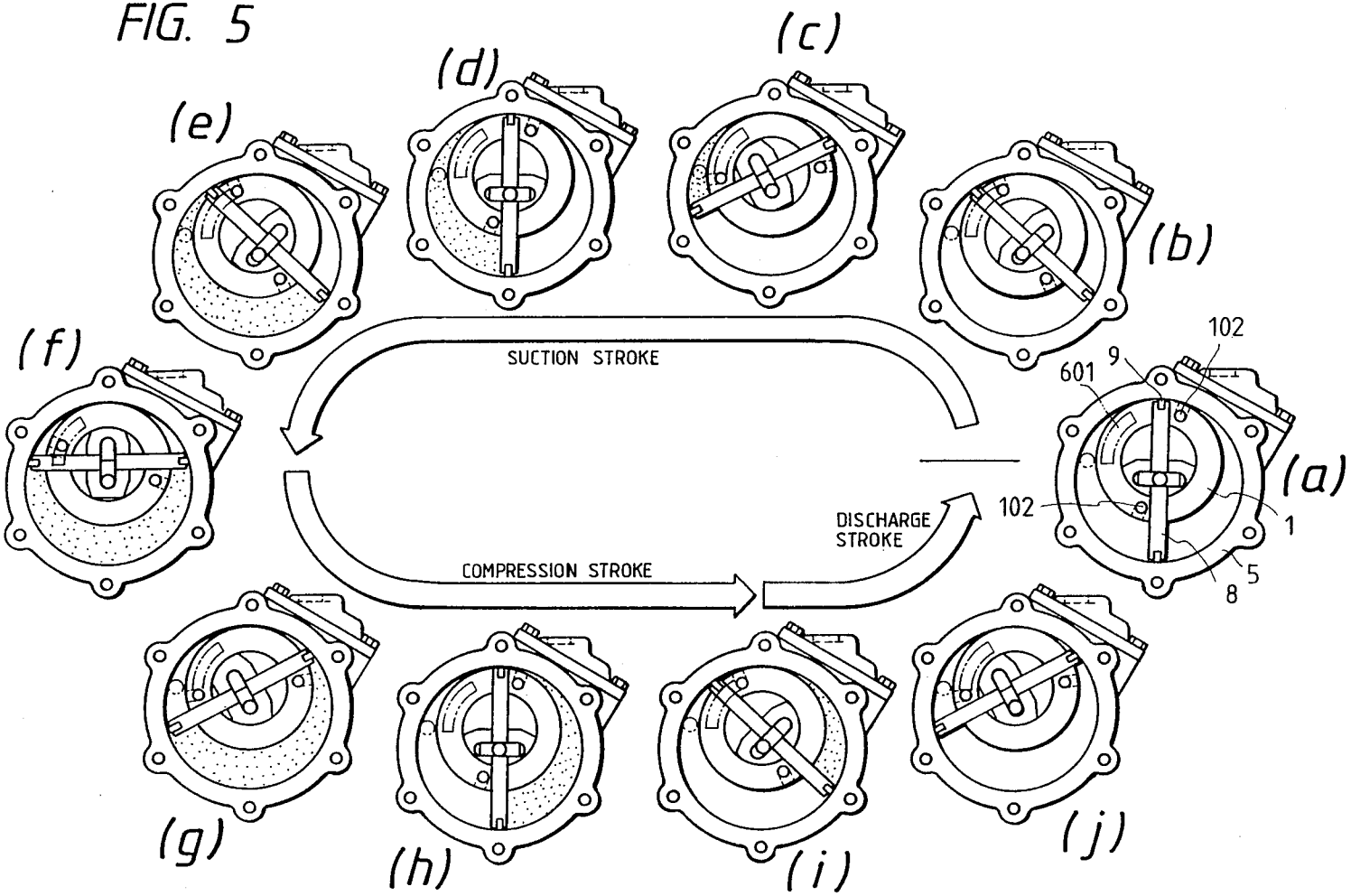
FIG. 5 is a schematic illustration for explaining operation of the rotary compressor illustration in FIGS. 1 to 4*d* at time of the operation of 100% capacity.

When the rotary compressor is used for an automobile air conditioner and a cool air is required, the rotary compressor is driven. When the second suction port 602 is opened with the solenoid valve 14 being energized as shown in FIGS. 4*a*, 4*c*, as shown in FIG. 5, the rotary compressor sucks gas from a state of (b) up to a state of (f) in which the second suction port 602 is closed by a rear vane positioned at the suction port 602 and the rotary compressor is in a maximum volume, and then compression and discharge are carried out thereby effecting a discharge of a maximum capacity.

Figure 4B:
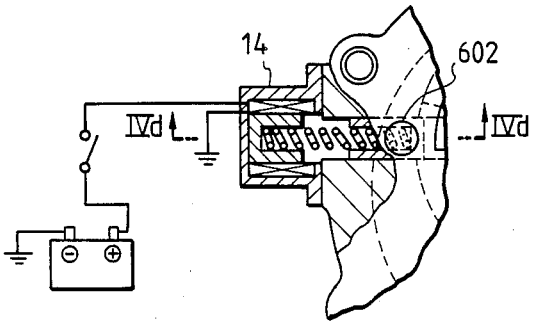
FIG. 4*b* is a detail view of a portion of FIG. 4*a* for explaining a solenoid valve employed in the rotary compressor.
Figure 4D:
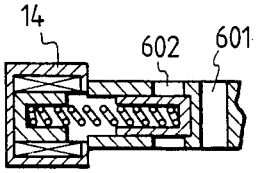
FIG. 4*d* is a sectional view taken along a line IV*d*—IV*d* of FIG. 4*b;*
Figure 6:
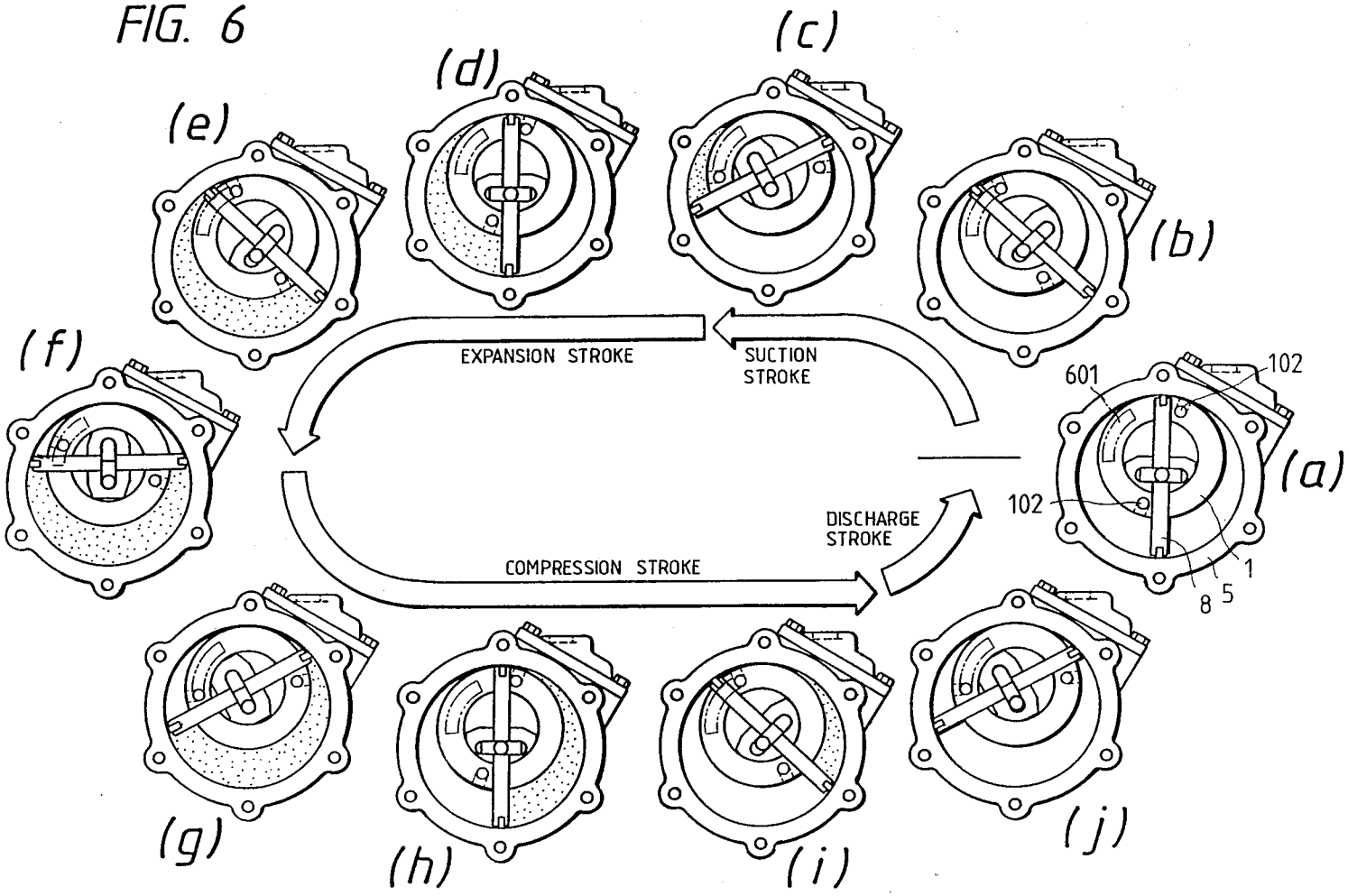
FIG. 6 is a schematic illustration for explaining an operation of the rotary compressor illustrated in FIGS. 1 to 4*d* at time of capacity control operation.

When the solenoid valve 14 is deenergized to close the second suction port 602, as shown in FIGS. 4*b*, 4*d*, the rotary compressor is subjected to a suction stroke from a state (b) to a state (c) shown in FIG. 6 in which the suction port 601 and the suction path 102 are communicated, then to adiabatic expansion stroke from the state (c) to the state (f), in which the suction port 601 is disconnected from the suction path 102 and expansion is effected in a closed working chamber 7, of FIG. 6. After that, the compression and discharge are effected as shown in FIG. 6. In this case, since the suction is effected until the state (c) of FIG. 6 after which the suction port 601 and the suction path 102 are disconnected, a discharge capacity is much less than when the second suction port 602 is opened.

As mentioned above, it is possible to change the capacity of the rotary compressor by on-off operation of the solenoid valve 14.

Figure 7:
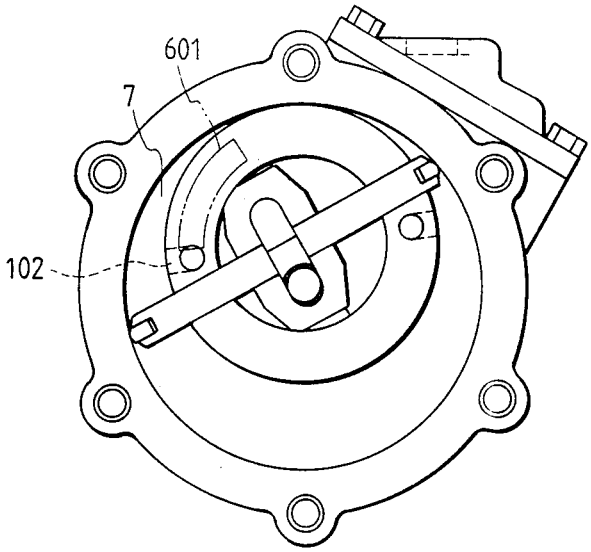
FIG. 7 is a schematic illustration for explaining capacity control range of the present invention.

In the above-described embodiment, the first suction port 601 is opened to the side face of the side plate 6, which side face is covered with the side face of the rotor 1, and the suction path 102 formed in the rotor 1 and communicating with the suction port 601 is disconnected from the suction port 601 as the rotor 1 rotates as shown in FIG. 7, so that the capacity at time of completion of the suction stroke by the first suction port 601 can be sufficiently reduced, whereby a control range in the capacity control can be extended sufficiently by providing the second suction port 602 controlled by the solenoid valve 14.

Figure 8B:
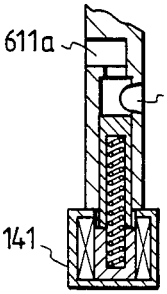
FIG. 8*b* is a sectional view taken along a line VIII*b*—VIII*b* of FIG. 8*a;*
Figure 8C:
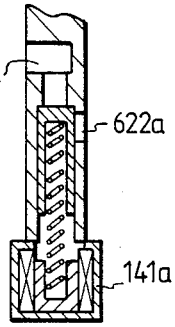
FIG. 8*c* is a sectional view taken alone a line VIII*c*—VIII*c* of FIG. 8*a;*
Figure 8A:
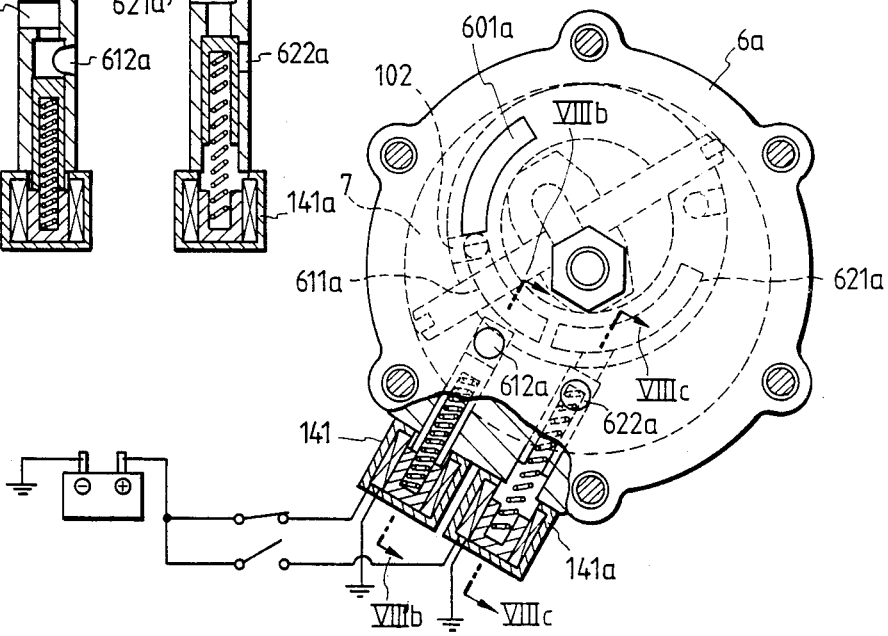
FIG. 8*a* is a sectional view of a variable-displacement rotary compressor of another embodiment of the present invention.

The rotary compressor of FIGS. 8*a*–8*c*, 9 and 10 is the same as shown in FIGS. 1 to 4 except for a construction of a rear side plate 6*a* and solenoid valves incorporated in the side plate 6*a*. In the rear side plate 6*a*, a first suction port 601*a*, a second suction port 611*a*, and a third suction port 621*a* are formed in a side portion of the rear side plate 6*a* which is covered with the side face of the rotor 1, and arranged in a circumferential direction, as shown in FIG. 8*a*. The first suction port 601*a* is always open to the low pressure chamber 13 as shown in FIG. 1 and communicates with the working chamber 7 through the suction path 102 formed in the rotor 1, but the second and third suction ports 611*a* and 612*a* are each formed so that communication between the working chamber 7 and the low pressure chamber 13 is controlled by solenoid valves 141, 141*a* incorporated in the rear side plate 6*a*. Namely, the first suction port 601*a* is formed in the rear side plate 6*a* in a similar construction to the suction port 601 of the embodiment of FIGS. 1–4. The second and third suction ports 611*a* and 621*a* each are opened, at one end thereof, to the low pressure chamber 13 through a suction path 621*a*, 622*a* formed in the rear side plate 6*a*, and opened, at the other end, to the side face of the rotor 1, so that the second and third suction ports 611*a*, 621*a* are communicable with the working chamber 7 through the suction path 102 as the rotor rotates. Solenoid valves 141, 141*a* are respectively provided on the suction paths 612*a*, 622*a* for opening and closing the suction paths 612*a*, 622*a*.

The solenoid valves 141, 141*a* shown in FIG. 8*a* present states of FIGS. 8*b* and 8*c*, respectively. Namely, the solenoid valve 141 opens the second suction port 611*a*, with the solenoid valve 141 being energized, and the solenoid valve 141*a* is deenergized to close the third suction port 621*a*. The third suction port 621*a* is formed at a position where the third suction port 621*a* communicates with the suction path 102 of the rotor 1 until the working chamber 7 under suction stroke reaches to a maximum suction volume.

Figure 9:
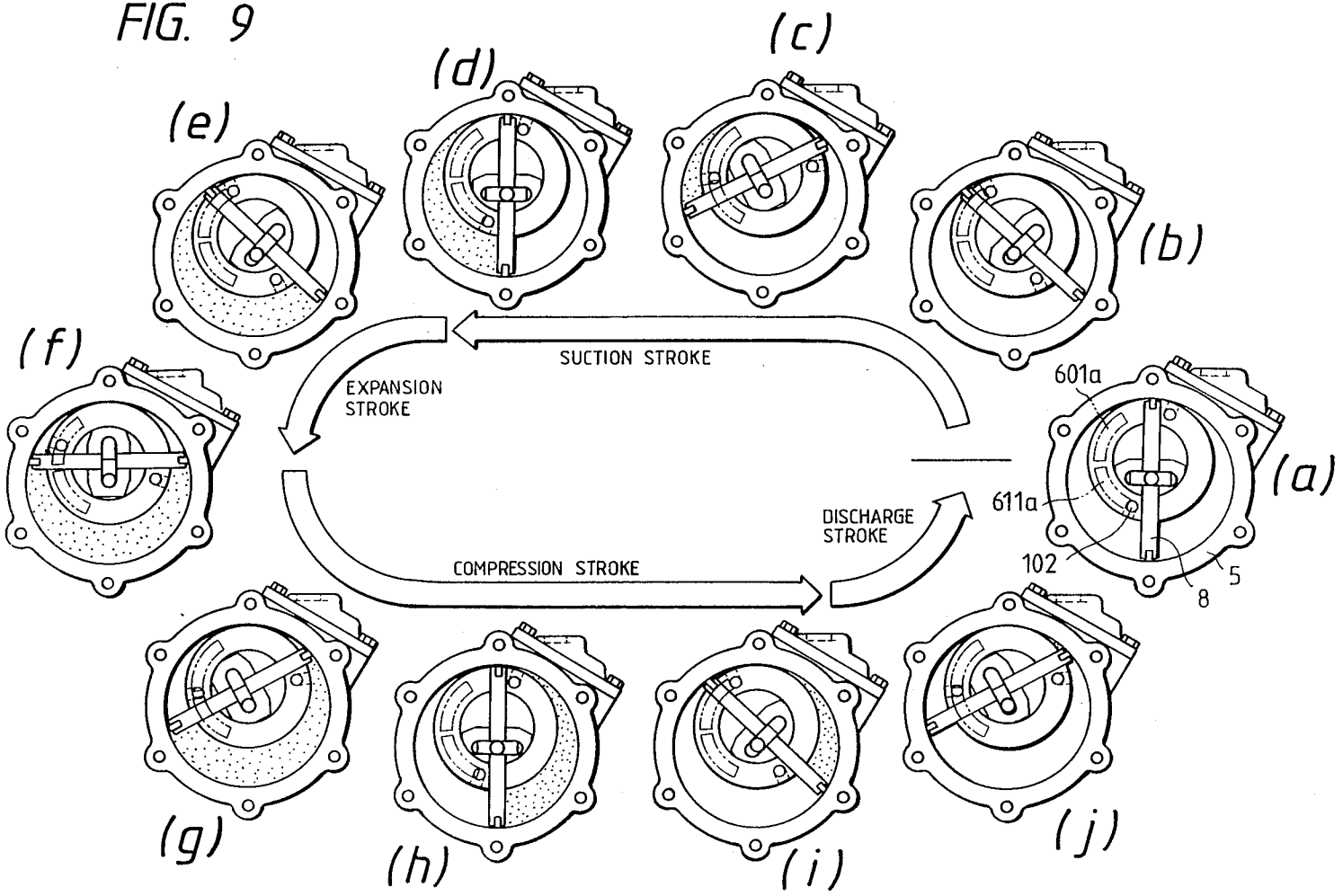
FIG. 9 is schematic illustration for explaining an operation of the rotary compressor illustrated in FIG. 8*a* to 8*c* at time of an intermediate capacity control operation.

The operational conditions of the rotary compressor shown in FIG. 8*a* are illustrated in FIG. 9. In FIG. 9, the first or second suction ports 601*a*, 611*a* communicates with the suction path 102 of the rotor 1 from a state (b) to a state (d), and the rotary compressor sucks a gas through the first and second suction port 601*a*, 611*a* and the suction path 102 communicating therewith. Then, the rotary compressor is subjected to expansion stroke until a state (f) wherein the gas is expanded in the working chamber 7 closed by the vane 8, and then subjecting to compression stroke and discharge stroke as illustrated in FIG. 9.

Figure 10:
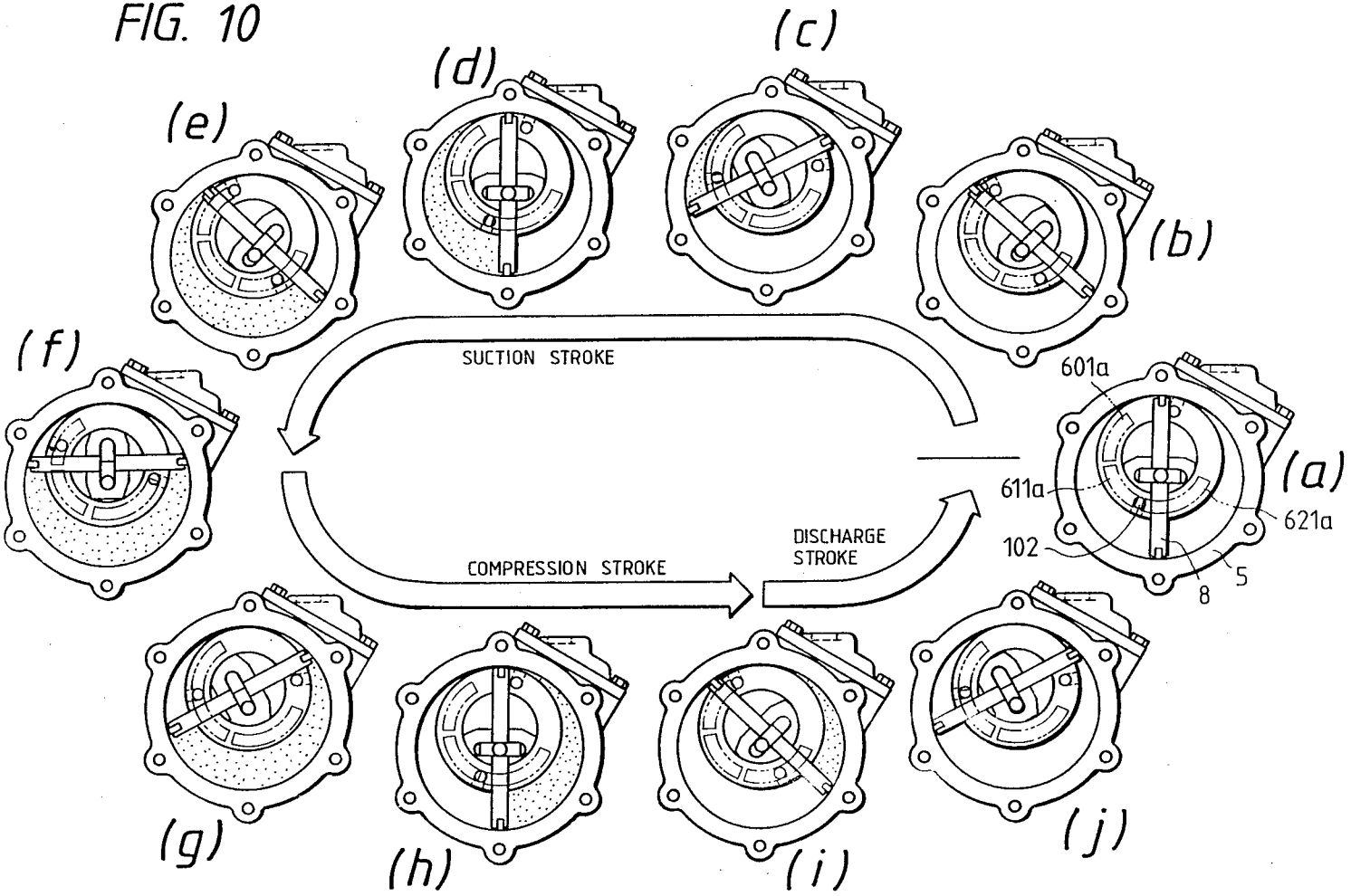
FIG. 10 is schematic illustration for explaining an operation of the rotary compressor illustrated in FIG. 8*a* to 8*c* at time of 100% capacity control operation.

Referring to FIG. 10, when the solenoid valve 141*a* being is energized to open the suction path 611*a*, the third suction port 621*a* in addition to the first and second suction ports 610*a*, 611*a* are in communication with the working chamber 7 under suction stroke when the suction path 102 of the rotor 1 communicates with the suction ports 601*a*, 611*a* and 621*a* through rotation of the rotor 1. In this case, the working chamber 7 is subjected to suction stroke from a state (b) to a state (f) of FIG. 10 and then to a compression stroke and a discharge stroke, and the discharge capacity of the rotary compressor is maximum.

Further, in the rotory compressor shown in FIG. 8*a*, when the second suction port 611*a* is interrupted to communicate with the low pressure chamber 13, with the suction path 612*a* being closed by deenergizing the solenoid valve 141 only the first suction port 601*a* communicates with the working chamber 7 and the low pressure chamber 13 through the suction path 102 of the rotor 1, the operational condition of the rotary compressor is the same as in FIG. 6. In this case, the suction stroke is effected from the state (b) to the state (c) of FIG. 10, and the suction capacity of the rotary compressor is minimum.

As mentioned above, in this embodiment, the capacity of the rotary compressor can be changed in three stages.

Figure 11:
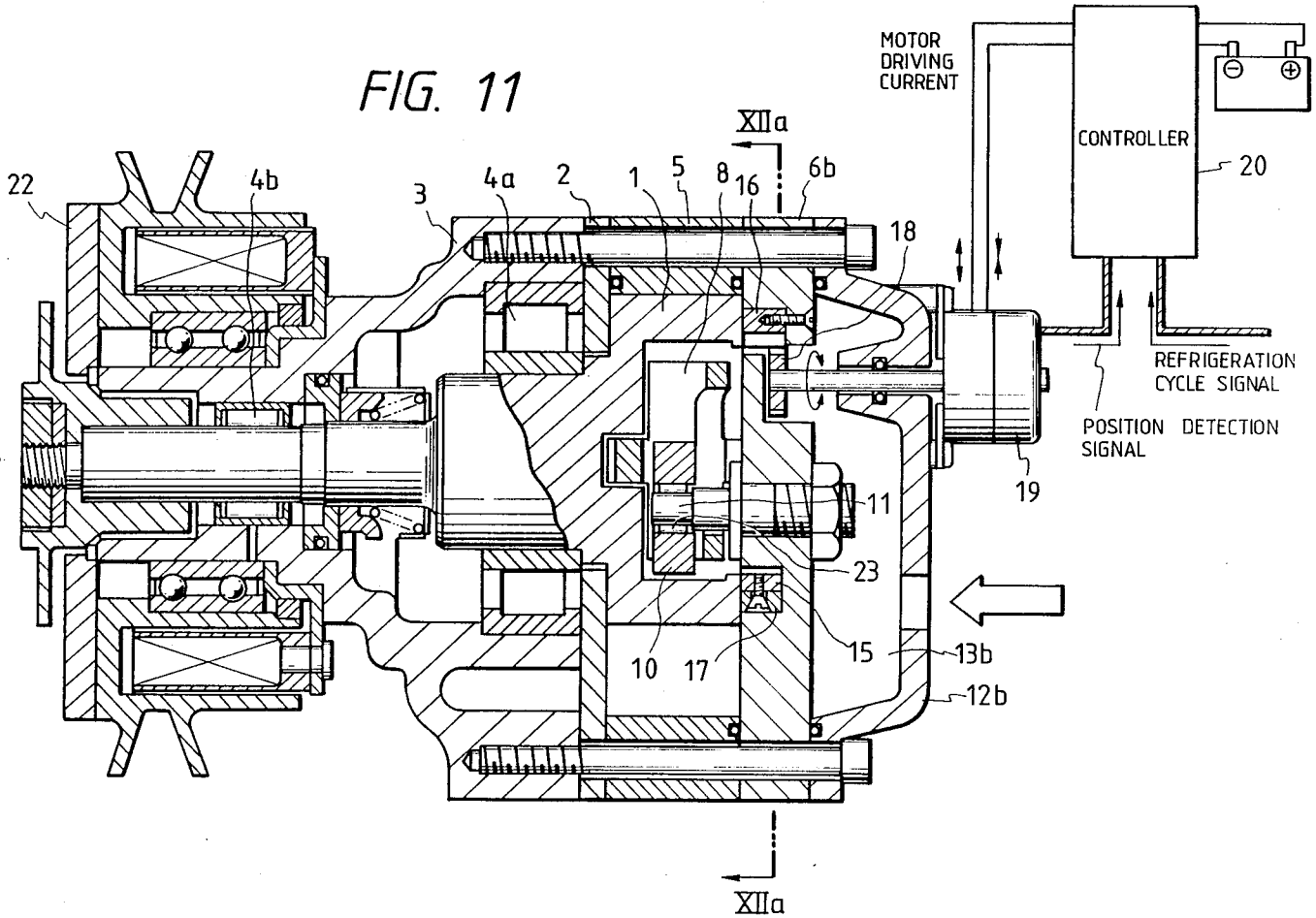
FIG. 11 is a sectional view of a variable-displacement rotary compressor of a further embodiment of the present invention.
Figure 12A:
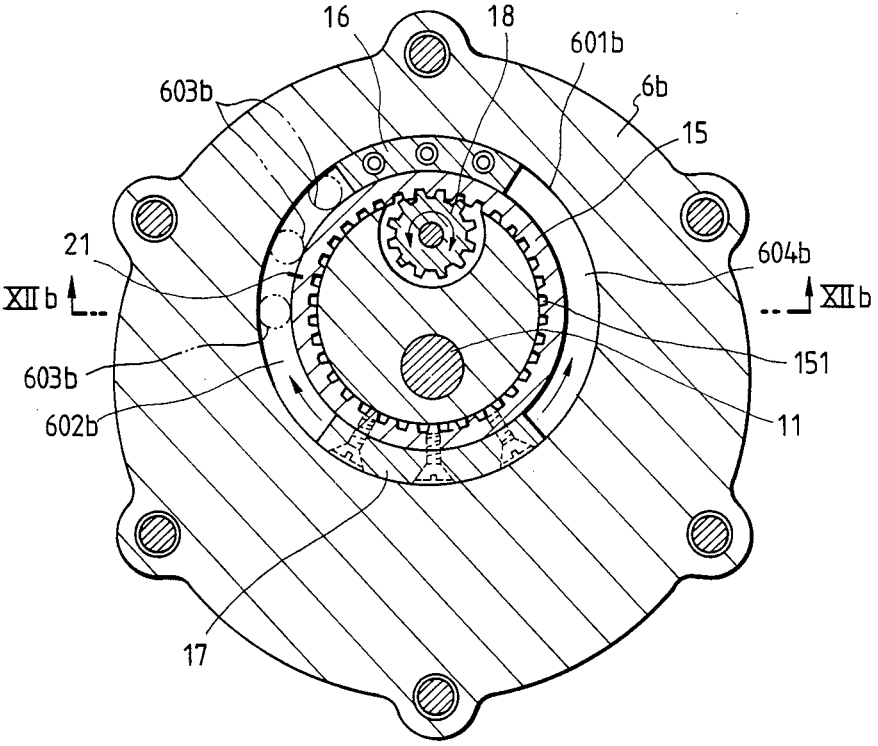
FIG. 12*a* is a sectional view taken along a line XII*a*—XII*a* of FIG. 11.
Figure 12B:
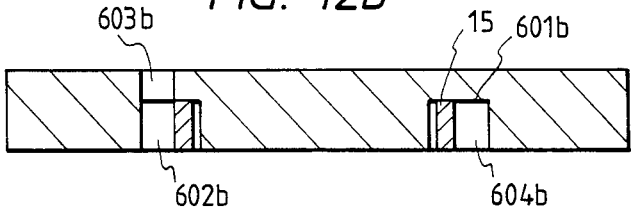
FIG. 12*b* is a sectional view taken along a line XII*b*—XII*b* of FIG. 12*a;*

In FIGS. 11, 12*a*, 12*b*, a constuction of the rotary compressor on a front or left side to a rear side plate 6*b* is common to the first and second-mentioned embodiments.

The rear side plate 6*b* has a ring-shaped groove 601*b* formed at a position corresponding to the side face of the rotor 1, as shown in FIG. 12*a*. In an inner peripheral side of the groove 601*b*, a ring-shaped member 15 is inserted slidably as shown in FIG. 12*b*. The thickness of the ring-shaped member 15 is substantially the same as the depth of the ring-shaped groove 601*b*, and the outer diameter of the ring-shaped member 15 is smaller than the outer diameter of the ring-shaped groove 601*b* whereby a ring-shaped space is defined therebetween. Partition members 16 and 17 are disposed in the ring-shaped space so as to divide the space into two spaces 602*b*, 604*b*, and fixed to the rear side plate 6*b* and the ring-shaped member 15, respectively. The ring-shaped member 15 has a stopper pin 21 fixed thereto to restrict rotating movement of the member 15 in one angular direction.

Figure 13A:
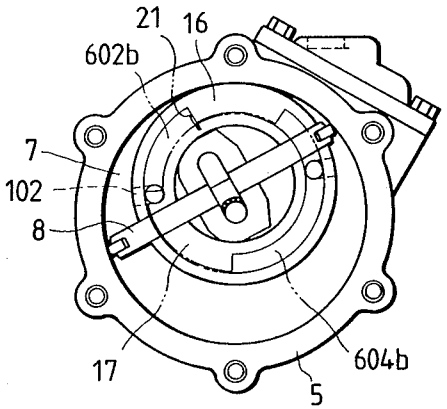
FIGS. 13*a*, 13*b*, 13*c* are schematic illustrations for explaining operation of the rotary compressor illustrated in FIGS. 11, 12*a*, 12*b* at time of minimum capacity operation, intermediate capacity operation and minimum capacity operation, of the rotary compressor, respectively.
Figure 13B:
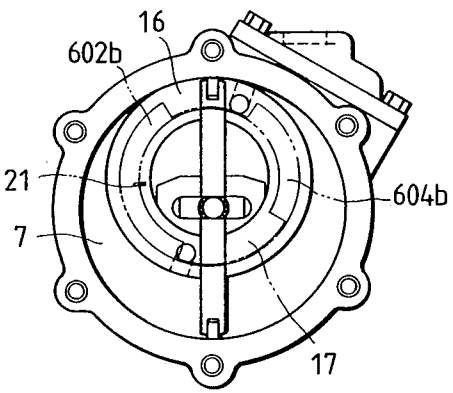
Figure 13C:
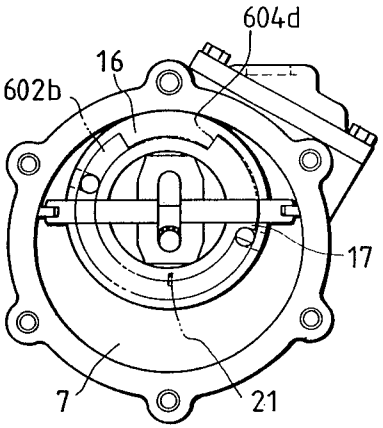

Further, the ring-shaped member 15 has teeth 151 formed in an inner peripheral face, and a pinion 18 meshed with the teeth 151 and rotatably mounted on the rear side plate 6*b*. The pinion 18 is rotated by a servomotor 19 mounted on an outside of a rear cover 12*b*. The space 602*b* is shaped in an arc, with the starting end of the arc-shaped space 602*b* being defined by the partition member 16, and the terminating end of the space 602*b* being formed by the partition member 17 secured to the rotatable ring-shaped member 15. The space 602*b* is opened to the low pressure or suction chamber 13*b* through holes 603*b*, and closed to the working chamber 7 by the side face of the rotor 1. The space 602*b* is brought into communication with the working chamber 7 by the suction path 102 formed by the rotor 1 through rotation of the rotor 1, which is illustrated in FIGS. 13*a* to 13*c*. The outer space 604*d* is not opened to the low pressure chamber 13*b*.

A length of the arc-shaped space 602*b* can be changed by shifting the partition member 17 through rotation of the ring-shaped member 15 as shown in FIGS. 13*a* 13*c*, whereby the capacity can be continuously changed.

A state of the arc-shaped space 602*b* as shown in FIG. 13*a* is in a condition wherein the partition member 17 is rotated until the stopper pin 21 reaches to the partition member 16, and the state is minimum in space. The compressor in such a condition sucks gas from the low pressure chamber 13*b* through the space 602*b* and the suction path 102 communicated with the space 602*b* through rotation of the rotor 1. The operational conditions of the rotary compressor in states of FIGS. 13*a*, 13*b* and 13*c* are substantially the same as ones shown in FIGS. 6, 9 and 10. The rotary compressor in a state of FIG. 13*b* is larger in capacity than in the state of FIG. 13*a* and smaller than in a state of FIG. 13*c*.

The servomotor 19 is controlled by a controller which receives refrigeration cycle signals representative of refrigeration cycle, operational conditions such as evaporation fin temperature, suction pressure, etc. and position detection signal representative of a capacity control position at an instant time, and outputs control signal to the controller 20 to thereby shift the partition member 17 so as to reach a desired capacity.

According to this embodiment, the capacity control can be continuously effected.

Figure 14:
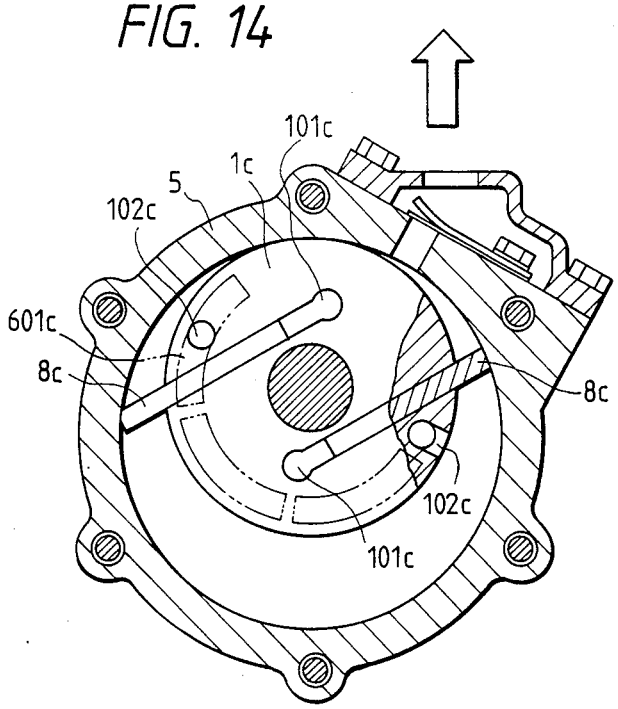
FIG. 14 is a sectional view of a variable-displacement rotary compressor of yet another embodiment of the present invention.

A rotary compressor shown in FIG. 14 is a modification of the embodiment shown in FIGS., with the 8*a*, 8*b*, 8*c*. compressor employing a pair of vanes 8*c* each slidably inserted in a groove formed in a rotor 1*c*. A bottom space 101*c* of the groove is pressurized thereby pressing a bottom face of the vane 8*c* and bringing the vane tip into contact with the cylinder 5. The other construction is the same as shown in FIGS. 8*a* to 8*c*. In the operation is such that, while a suction port 601*a* formed in a rear side plate (not shown) communicates with a suction path 102*c* formed in the rotor 1*c*, the compressor sucks a fluid from a low pressure chamber into a working chamber under suction stroke, and the fluid is compressed by the vane 8*c* rotating.

Figure 15:
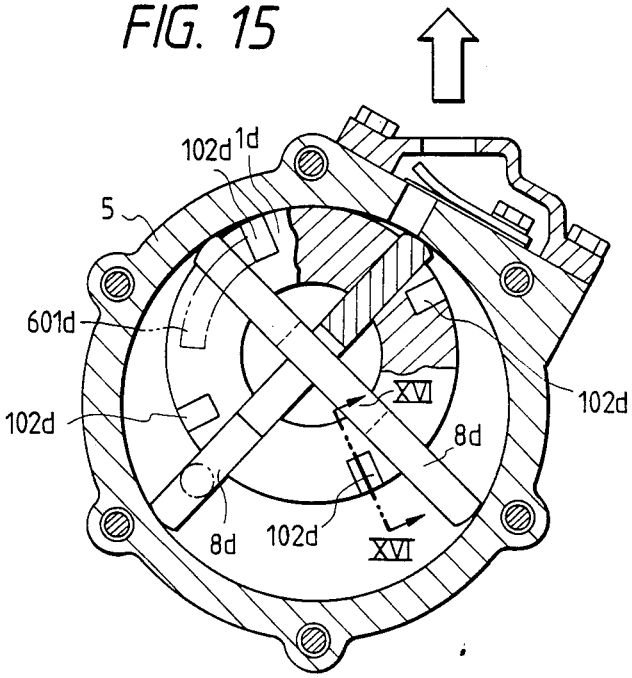
FIG. 15 is a sectional view of a variable-displacement rotary compressor of a still further embodiment of the present invention.

A rotary compressor shown in FIG. 15 has a pair of vanes 8*d* crossing each other at 90° and passing through a rotor 1*d*. One of both ends of the vane 8*d* is always in contact with the cylinder 5, whereby the vanes 8*d* are radially moved through contact with the cylinder with respect to the rotor 1*d*. Construction of the rotary compressor is substantially the same as the first-mentioned embodiment except for the vane 8*d* and the rotor 1*d*.

A suction port 601*d* corresponding to the suction port 601 of the FIG. 3 is formed in a rear side plate 6*d* opened to a low pressure chamber (not shown) and the side face of the rotor 1*d*. The rotor 1*d* has suction path each formed at a position immediately rear side to the vane 8*d* with respect to the rotational direction of the rotor 1*d*. The suction path 102*d* communicates with the suction port 601*d* through rotation of the rotor 1*d* whereby the rotary compressor sucks gas. In all other respects the rotary compressor of FIG. 15 functions in the same manner as the first-mentioned embodiment.

Figure 16:
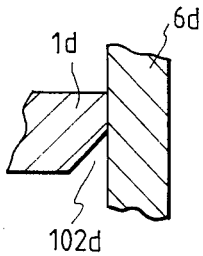
FIG. 16 is a sectional view taken along a line XVI—XVI of FIG. 15.

A form of the suction path 102*d* is shown in FIG. 16. The suction path 102*d* is formed by chamfering a part of a corner of the outer periphery of the rotor 1*d*. This construction is simpler than the other example of the suction path.

The present invention can be applied to any rotary compressor irrespective of the number of vanes and a driving type of the vane.

Further, in the above-mentioned embodiments, the suction ports formed in the side plate and the suction path formed in the rotor are provided on a rear side of the rotary compressor. However, the suction ports and the suction path can be provided on a front side of the rotary compressor. That is, the suction ports can be formed in a front side cover and the suction path is formed on a front side of the rotor.

Figure 17:
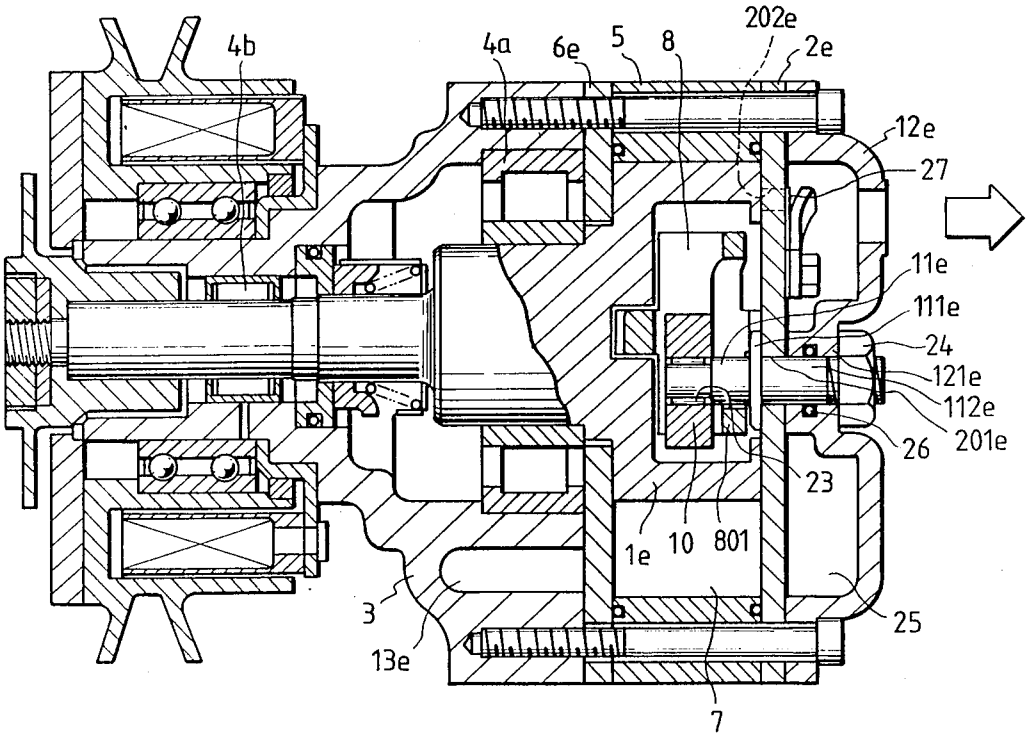
FIG. 17 is a sectional view of a variable-displacement rotary compressor of another embodiment of the present invention.

More particularly, as shown in FIG. 17, a front side plate 6*e* is provided with a suction port (not shown) similar to the suction port 601 shown in FIG. 4*a* and a rotor 1*e* has a suction path (not shown) which communicates with the suction port of the front side plate 6*e* through rotation of the rotor 1 whereby the compressor sucks gas from a low pressure chamber 13*e* formed in a front cover 3 into a working chamber 7 defined by a cylinder 5 and the rotor 1*e*. A rear side plate 2*e* and the rear cover 12*e* are piled and connected by bolts together with the front cover 3, the front side plate 6*e* and the cylinder 5. The rear side plate 2*e* has a slider pin 11*e* secured thereto at a central portion thereof, with the slider pin 11e having a slider 10 rotatably mounted thereon. The slider 10 is slidably inserted in a central guide portion 801 of a vane 8 through bearing means 23, which construction is the same as in FIG. 2. The rear cover 12*e* is deformed at a central portion to provide a boss portion 121*e* which is in contact with the rear side cover 2*e*. The slider pin 11*e* has a flange 111*e* and a bolt portion 112*e* projecting outward from the flange 111*e*, passes through a hole 201*e* of the rear side plate 2*e* and a boss portion 121*e* of the rear cover 12*e*, and fastens the rear side plate 2*e* and the rear cover to unite them by a nut 24. An O-ring 26 provides a seal between the bolt portion 112*e* and the boss portion 121*e*. A discharge chamber 25 is defined by the rear side plate 2*e* and the rear cover 12*e*.

In this type of rotary compressor, pressure difference takes place between the working chamber 7 and the high pressure chamber 25. Namely, a portion of the working chamber 7 is filled with a low pressure gas immediately after suction of the gas into the working chamber 7 and the high pressure chamber 25 contains compressed high pressure gas, so that the rear side plate 2*e* defining the working chamber 7 and the high pressure chamber 25 is subjected to a lower pressure at a portion on one side thereof and to a higher pressure on the other side. Further the rear cover 12*e* also is subjected to pressure difference because the outside of the rear cover 12*e* is subjected to low pressure in the surrounding and the inside is in the high pressure.

The rotary compressor according to this embodiment has the rear side plate 2*e* and the rear cover 12*e* secured to the rear side plate 2*e* at the circumferential portion and the central portion so that the rigidity is greatly increased. Therefore, the rear side plate 2e and the rear cover 12e can be made of very thin plate but yet have a sufficient rigidity to avoid the deformation due to the pressure difference.

Further, a space volume of the discharge port 202e at an upstream side of a valve 27, as viewed in a flow direction of a gas, is reduced, and, as a result, an amount of the gas remaining there is reduced, so that improvement on the compression efficiency and a lowering effect of temperature of the discharge gas can be achieved.

Still further, the rotor 1e is rotatably supported in a cantilever manner by the front cover 3 through bearings 4a, 4b each of which have a different construction, so that the rear side plate 2e is not provided with any projections such as a boss and flat. Therefore, a mounting face of the boss portion 121e of the rear cover 12e can be at the same level as one of the mounting face of the peripheral portion thereof. Therefore, plane reduction of these mounting portions is easy and precise scale can be easily obtained.

Figure 18:
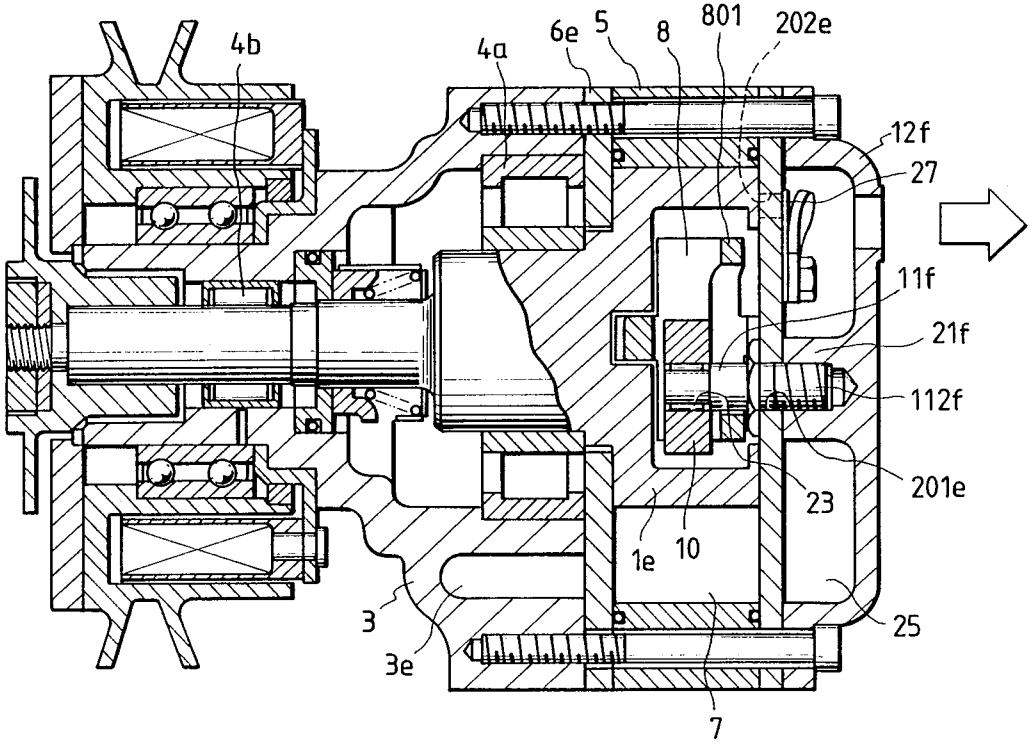
FIG. 18 is a sectional view showing a modification of FIG. 17.

In FIG. 18 a slider pin 11f has bolt portion 112f, on one side thereof, and a rear cover 12f has a boss 21f is which a blind hole with screw is formed. By employing the blind hole, a high sealing effect is obtained without any O-rings. The boss 21f is fastened to the rear side plate by the slider pin 11f and, in all other respects, the construction of FIG. 18 is the same as in FIG. 17.

According to the present invention, the variable-displacement rotary compressor can control its capacity when desired. The control range of the capacity can be wide, so that frequent on-off operation of the magnetic clutch which was used for controlling the refrigeration capacity of an air conditioner is greatly reduced and acceleration shock accompanying the operation of the magnetic clutch can be prevented.

Further, the rotary compressor can be made compact, and light in weight.

What is claimed is:

1. A variable-displacement rotary compressor comprising:

a cylinder having an inner surface;

a rotor rotatably disposed in said cylinder so that an outer surface of said rotor is in contact with or in a close relationship to said inner surface of said cylinder at least at one circumferential position of said cylinder and spaced from said inner surface of said cylinder at other circumferential positions, thereby defining a working chamber between said cylinder and said rotor;

side plate means for closing both axial ends of said cylinder;

at least one vane means provided in said rotor so as to move inwardly and outwardly with respect to the outer surface of said rotor for dividing said working chamber into a plurality of chambers;

a low pressure chamber communicable with one side divided working chambers under a suction stroke through a suction passage, the suction passage comprising:

a suction port formed in one of said side plate means at a position where said side plate means is in contact with or in an adjacent relationship to an end face of said rotor, said suction port communicating with said low pressure chamber, said suction port formed in said plate means extends in a rotating direction of said rotor from a starting end to a terminating end, and communication between said working chamber and said low pressure chamber by said suction passage including said suction port is interrupted at said terminating end before said working chamber under the suction stroke reaches a maximum capacity thereof; and a suction path formed in said rotor, one end of said suction path opening to the end face of said rotor in abutment with said side plate means having said suction port and being communicable with said suction port through rotation of said rotor, and the other end of said suction path opening to said working chamber through the outer surface of said rotor, whereby said working chamber under the suction stroke communicates with said low pressure chamber through said suction port of said side plate means and said suction path of said rotor to suck a fluid from said low pressure chamber into said working chamber under the suction stroke.

2. A variable-displacement rotary compressor as define in claim 1, further comprising means for changing said terminating end of said suction port formed in said side plate means.

3. A variable-displacement rotary compressor as defined in claim 2, wherein said terminating end of said suction port is defined by a slidable partition member, and wherein a position of said terminating end of said side plate means is changed by sliding said slidable partition member.

4. A variable-displacement rotary compressor comprising:

a cylinder having an inner surface;

a rotor rotatably disposed in said cylinder so that an outer surface of said rotor is in contact with or in a close relationship to said inner surface of said cylinder at least at one circumferential position of said cylinder and spaced from said inner surface of said cylinder at other circumferential positions, thereby defining a working chamber between said cylinder and said rotor;

side plate means for closing both axial ends of said cylinder;

at least one vane means provided in said rotor so as to move inwardly and outwardly with respect to the outer surface of said rotor for dividing said working chamber into a plurality of chambers;

a low pressure chamber communicable with one of said divided working chambers under a suction stroke through a suction passage, the suction passage comprising:

a first suction port formed in one of said side plate means at a position where said side plate means is in contact with or in as adjacent relationship to an end face of said rotor, said first suction port communicating with said low pressure chamber;

a second suction port formed independently of said suction port in said side plate means in which said first suction port is formed, so that said second suction port is directly communicated with said low pressure chamber and said working chamber under the suction stroke;

means for closing and opening said second suction port; and a suction path formed in said rotor, one end of said suction path opening to the end face of said rotor in abutment with said side plate means having said first suction port and being communicable with said first suction port through rotation of said rotor, and the other end of said suction path opening to said working chamber through the outer surface of said rotor, whereby said working chamber under the suction stroke communicates with the low pressure chamber through said first suction port of said side plate means and said suction path of said rotor to suck a fluid from said low pressure chamber into said working chamber under the suction stroke.

5. A variable-displacement rotary compressor as defined in claim 4, wherein said means for closing and opening said second suction port includes a solenoid valve means.

6. A variable-displacement rotary compressor comprising:

a cylinder having an inner surface;

a rotor rotatably disposed in said cylinder so that an outer surface of said rotor is in contact with or in a close relationship to said inner surface of said cylinder at least at one circumferential position of said cylinder and spaced from said inner surface of said cylinder at other circumferential positions, thereby defining a working chamber between said cylinder and said rotor;

side plate means for closing both axial ends of said cylinder;

at least one vane means provided in said rotor so as to move inwardly and outwardly with respect to the outer surface of said rotor for dividing said working chamber into a plurality of chambers;

a low pressure chamber communicable with one of said divided working chambers under a suction stroke through a suction passage, the suction passage comprising:

a first suction port formed in one of said side plate means at a position where said side plate means is in contact with or in an adjacent relationship to an end face of said rotor, said first suction port communicating with said low pressure chamber;

a suction path formed in said rotor, one end of said suction path opening to the end face of said rotor in abutment with said side plate means having said suction port and being communicable with said suction port through rotation of said rotor, and the other end of said suction path opening to said working chamber through the outer surface of said rotor, whereby said working chamber under the suction stroke communicates with said low pressure chamber through said suction port of said side plate means and said suction path of said rotor to suck a fluid from said low pressure chamber into said working chamber under the suction stroke;

a further suction port independent of said first suction port opened to the end face of the rotor and communicable with said suction path of said rotor, said further suction port communcates with a suction passage opened to said low pressure chamber; and means provided on said suction passage for opening and closing said suction passage.

7. A variable-displacement rotary compressor comprising:

a cylinder having an inner surface;

a rotor rotatably disposed in said cylinder so that an outer surface of said rotor is in contact with or in a close relationship to said inner surface of said cylinder at least at one circumferential position of said cylinder and spaced from said inner surface of said cylinder at other circumferential positions, thereby defining a working chamber between said cylinder, one of said plate means and a rear cover means defined a high pressure chamber and are joined by screw means at central portions thereof;

at least one vane means provided in said rotor so as to move inwardly and outwardly with respect to the outer surface of said rotor for dividing said working chamber into a plurality chambers;

a low pressure chamber communicable with one of said divided working chambers under a suction stroke through a suction passage, the suction passage comprising:

a suction port formed in one of said side plate means at a position where said side plate means is in contact with or in an adjacent relationship to an end face of said rotor, said suction port communicating with said low pressure chamber; and a suction path formed in said rotor, one end of said suction path opening to the end face of said rotor in abutment with said side plate means having said suction port and being communicable with said suction port through rotation of said rotor, and the other end of said suctin path opening to said working chamber throught the outer surface of said rotor, whereby said working chamber under the suction stroke communicates with said low pressure chamber through said suction port of said side plate means and said suction path of said rotor to suck a fluid from said low pressure chamber into said working chamber under the suction stroke.

8. A variable-displacement rotary compressor as defined in claim 6, wherein said screw means includes a slider pin means for slidably mounting a slider guiding a central portion of said at least one vane means.

9. A variable-displacement rotary compressor comprising:

a cylinder having a cylindrical inner surface;

a rotor rotatable about a central axis and eccentrically disposed in said cylinder so that an outer surface of said rotor is in contact with said inner surface of said cylinder at least at one position with respect to a circumferential direction and spaced from said inner surface of said cylinder at other positions with respect to the circumferential direction;

side plate means disposed at side faces of said rotor and said cylinder for defining a working chamber with said inner surface of said cylinder and said outer surface of said rotor;

cover plate means disposed in opposition to one of said side plate means for forming a low pressure chamber;

at least one vane means provided in said rotor so as to move inwardly and outwardly with respect to said outer surface of said rotor for dividing said working chamber into a plurality of chambers;

a first suction port means in said side plate means for defining said low pressure chamber, and being opened to both said low pressure chamber and an abutment face thereof to said side face of said rotor, said suction port means extending from a position near to a contact portion between said rotor and said cylinder in a rotational direction of said rotor;

suction path formed in said rotor, and opened to both the abutment face of said rotor to said side plate means defining said low pressure chamber and said working chamber, said suction path being brought into communication with said first suction port of said side plate means through rotation of said rotor so that one of the plurality of chambers under a suction stroke communicates with said low pressure chamber through said suction path of said rotor and said first suction port means of said side plate means, whereby the rotary compressor sucks a fluid from said low pressure chamber into one of the plurality of chambers under the suction stroke, said first suction port means being interrupted to communicate with said suction path of said rotor before said one of said plurality of chambers under the suction stroke reaches a maximum capacity; and a second suction port means formed in said side plate means for defining said low pressure chamber so as to directly communicate with said working chamber and said low pressure chamber until said one of said plurality of chambers under the suction stroke reaches about a maximum capacity.

10. A variable-displacement rotary compressor as defined in claim 9, wherein said second suction port means includes at least one opening means opened to said working chamber, and said at least one opening means has a length in the rotational direction of the rotor less than a thickness of said at least one vane means.

11. A variable-displacement rotary compressor as defined in claim 9, further comprising means for closing and opening said second suction port to thereby control a capacity of the variable-displacement rotary compressor.

12. A variable-displacement rotary compressor as defined in claim 9, wherein said second suction port means includes a plurality of opening means respectively opening to said working chamber, and said plurality of opening means each have a length in the rotational direction of the of the rotor less than a thickness of said at least one vane means.

13. A variable-displacement rotary compressor as defined in claim 1, wherein one of said side plate means and a rear cover means define a high pressure chamber and are joined by screw means at central portions thereof.

14. A variable-displacement rotary compressor as defined in claim 13, wherein said screw means includes a slider pin means for slidably mounting a slider guiding a central portion of said at least one vane means.

15. A variable-displacement rotary compressor according to claim 1, further comprising a second suction port means formed independently of said part means in said first plate means in which said suction port means is formed, so that said second suction port means is directed communicated with said working chamber under the suction stroke, and means for closing and opening said second suction port means.

16. A variable-displacement rotary compressor according to claim 15, wherein said means for closing and opening said second suction port means includes a solenoid valve means.

* * * * *